US007757979B2

(12) United States Patent
Stelk

(10) Patent No.: US 7,757,979 B2
(45) Date of Patent: Jul. 20, 2010

(54) HAMMERMILL HAMMER WITH PIN-HOLE INSERT

(75) Inventor: John C. Stelk, Davenport, IA (US)

(73) Assignee: Riverside Products, Inc., Bettendorf, IA (US)

( * ) Notice: Subject to any disclaimer, the term of this patent is extended or adjusted under 35 U.S.C. 154(b) by 0 days.

(21) Appl. No.: 12/098,130

(22) Filed: Apr. 4, 2008

(65) Prior Publication Data

US 2009/0250539 A1 Oct. 8, 2009

(51) Int. Cl.
*B02C 13/26* (2006.01)

(52) U.S. Cl. ..... 241/25; 241/194; 241/195

(58) Field of Classification Search ..... 241/286, 241/194, 195, 197, 30, 25; 29/428, 426.1
See application file for complete search history.

(56) References Cited

U.S. PATENT DOCUMENTS

| | | | |
|---|---|---|---|
| 3,844,494 | A | 10/1974 | Hightower |
| 4,142,687 | A | 3/1979 | Potwin |
| 5,381,975 | A | 1/1995 | Chon et al. |
| 5,598,981 | A | 2/1997 | Hellmich |

*Primary Examiner*—Mark Rosenbaum
(74) *Attorney, Agent, or Firm*—Jennifer R. Racine; Godfrey & Kahn, P.C.

(57) ABSTRACT

A hammer for a hammermill includes an elongated pin hole and a pin-hole insert that allows the hammer to be mounted in a first position and a second position on a rotor of a hammermill to prolong the useful life of the hammer. The insert is installed in the pin hole using corresponding mating features. A hammer assembly and method for prolonging the life of hammers in a hammermill are also described.

7 Claims, 6 Drawing Sheets

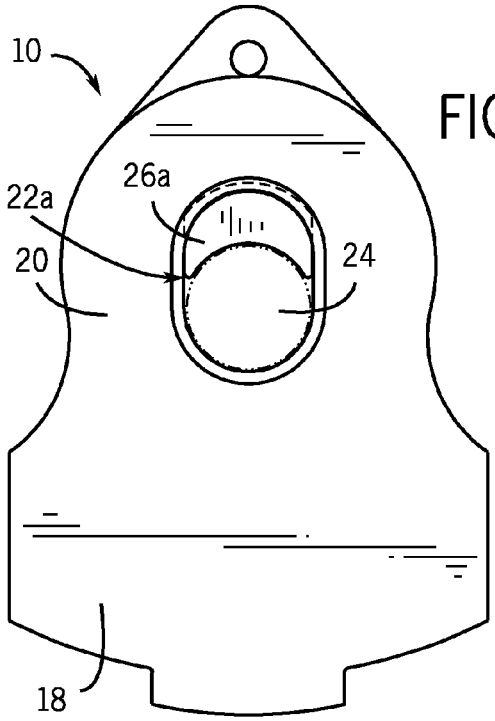
FIG. 6
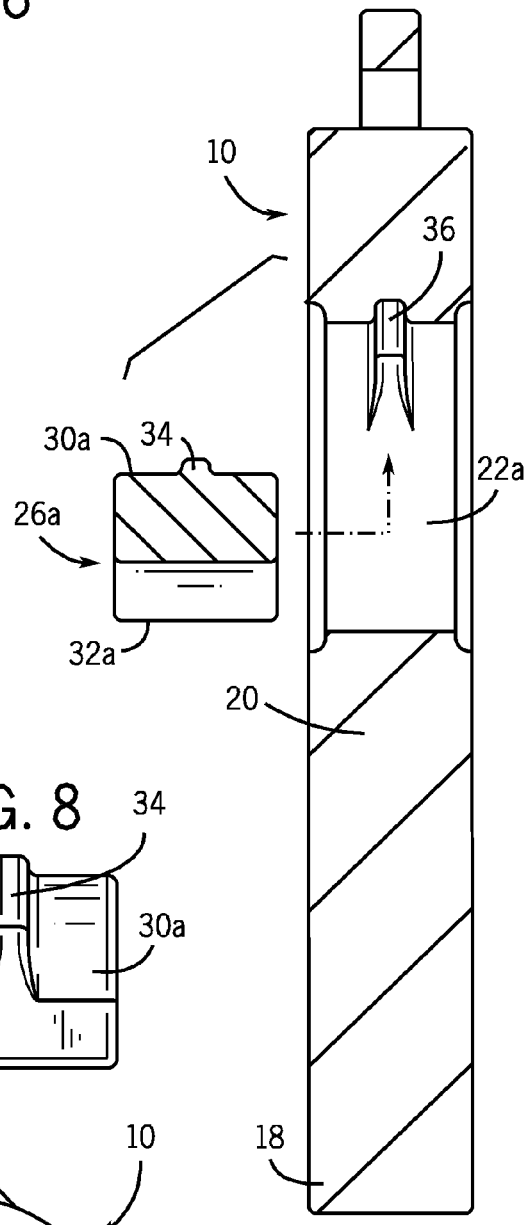
FIG. 9
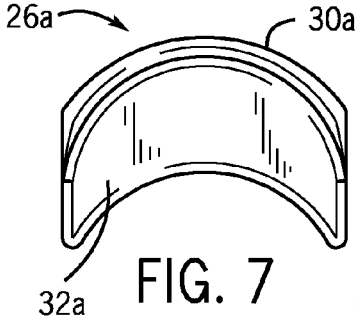
FIG. 7
FIG. 8
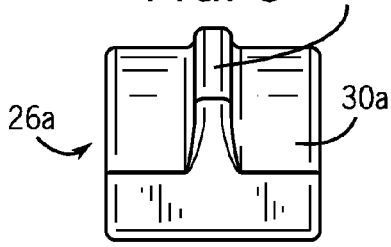
FIG. 5
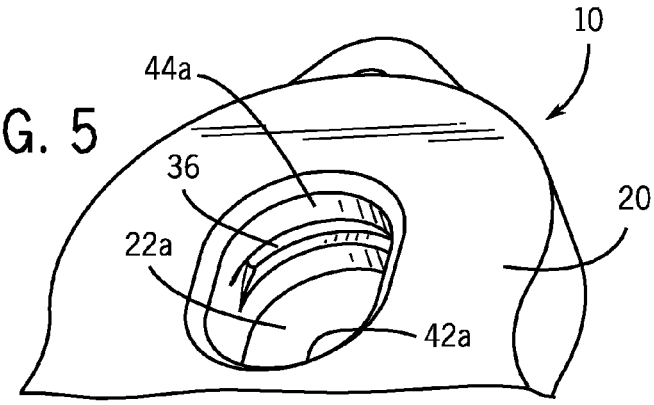

FIG. 15
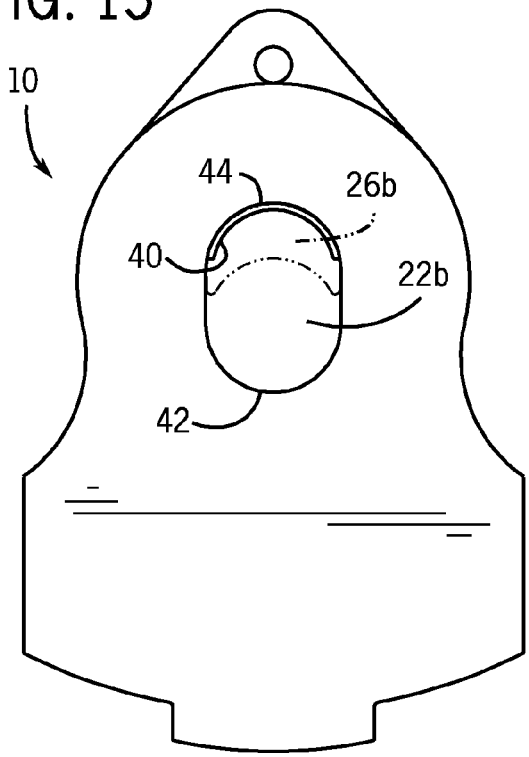
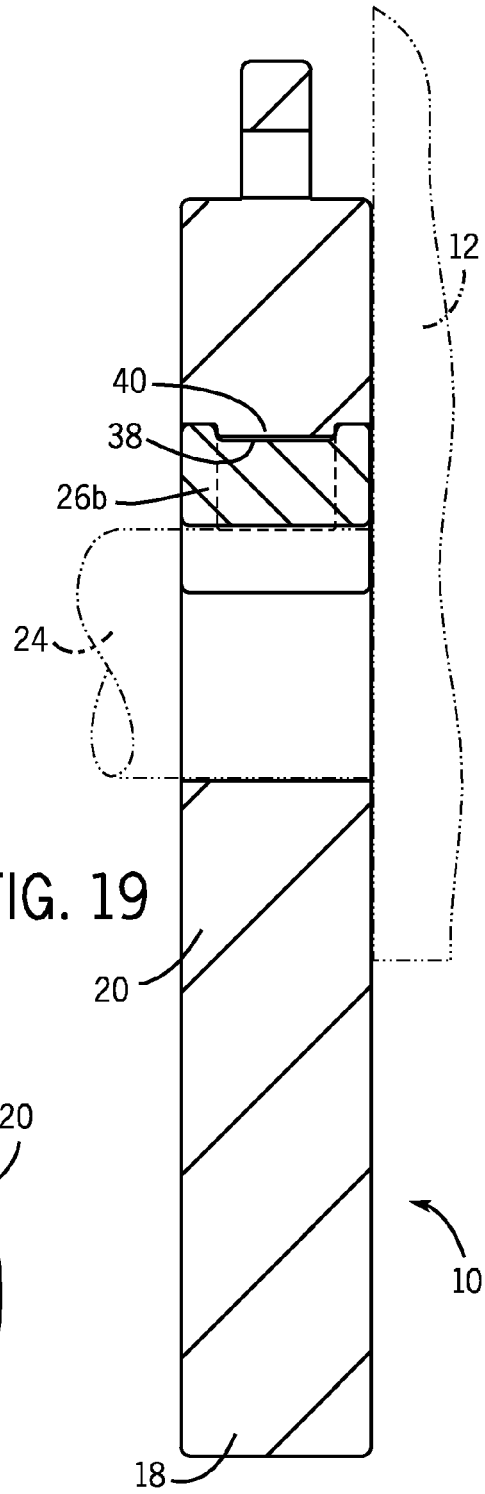
FIG. 19
FIG. 14
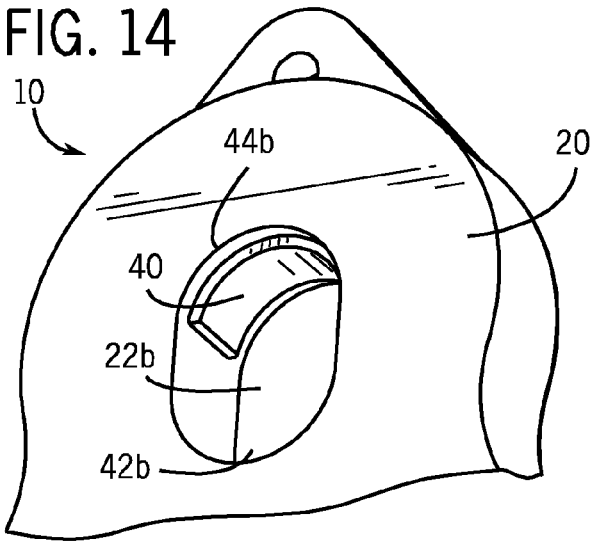

HAMMERMILL HAMMER WITH PIN-HOLE INSERT

FIELD OF THE INVENTION

The present invention relates generally to hammermills for shredding scrap materials, and more particularly to a hammermill hammer having a pin-hole insert for adjustable installation.

BACKGROUND OF THE INVENTION

Hammermills for shredding scrap materials such as automobiles shred or fragment the scrap materials using a rotor assembly with a plurality of impact hammers mounted thereon. The hammers are generally mounted to the rotors using pins and swing freely on the pins as the rotor rotates and the hammers contact scrap materials. The hammers are subjected to extreme wear conditions, and must often be replaced at significant cost. Many replacement methods and hammer designs have been employed in an effort to reduce the frequency at which the hammers must be replaced and the cost to do so.

One common practice for prolonging the life of the hammers is the use of two-piece hammers or hammers with replaceable tips. As shown, for example, in U.S. Pat. No. 3,829,032 to Schrimper, U.S. Pat. No. 4,000,889 to Whitney, and U.S. Pat. No. 4,202,504 to Cameron, a tip is mounted on the end of the hammer. As the hammer is in use, the tip is subjected to the most wear. The tips are easier and less expensive to replace than the entire hammer. Another method for dealing with hammer wear is to include a series of pin holes along the hammer. The pin hole nearest the impact end of the hammer would be used first, and then as the impact end of the hammer became worn, the next pin hole would be used. This practice prolongs the life of the hammer, but movement of the hammer pins from one pin hole to another is still costly and inefficient. One response to that problem is shown in U.S. Pat. No. 5,381,975 to Chon et al. (the "Chon et al. patent"), which discloses a hammer that allows for changing pin holes without removal of the hammer pin. Instead of discrete pin holes along the length of the hammer, the hammer in the Chon et al. patent includes an elliptical slot and a removable plug. To move the hammer to a new pin location when worn, the plug is removed, the hammer is moved into its new location, and the plug is replaced to hold the hammer in place.

Although existing methods for extending the life of the hammers have certain benefits and advantages, existing methods also have limitations. In particular, the common methods are not very effective for heavy industrial shredding applications, such as the shredding of scrap automobiles, trucks and the like. Such applications require much larger hammermills and hammers, which makes replacement of any parts even more costly and inefficient, and any additional parts used in connection with mounting the hammers to the hammermill rotors must be especially robust.

The present invention relates to improvements over the hammers and hammer assemblies described above, and to solutions to the problems raised or not solved thereby.

SUMMARY OF THE INVENTION

The present invention provides a hammer assembly for a hammermill. The hammer assembly includes a shaft, at least one rotor mounted on the shaft, at least one hammer rotatably mounted on the rotor, and at least one insert. The at least one hammer has an elongated pin hole with a first end and a second end. A mating feature is disposed within the second end of the pin hole. The insert has a top surface and a bottom surface, the top surface having a corresponding mating feature disposed thereon and the bottom surface shaped to accommodate a hammer pin. The hammer can be rotatably mounted on the rotor in a first position when the insert is mated with the pin hole and the hammer can be mounted on the at least one rotor in a second position when the insert is removed from the pin hole.

The present invention also includes a hammer for a hammermill. The hammer includes at least one impact end and a body, an elongated pin hole in the body, a longitudinal mating feature disposed within the elongated pin hole, and an insert having a corresponding mating feature disposed on a top surface thereof. The insert can be mated with the pin hole to mount the hammer in a first position on a rotor and the insert can be removed from the pin hole to mount the hammer in a second position on a rotor.

A method for prolonging the life of a hammer in a hammermill is also contemplated by the present invention. The method includes the steps of: mounting a hammer in a first position on a rotor of a hammermill, wherein the hammer includes at least one impact end and a body, an elongated pin hole in the body, a longitudinal mating feature disposed within the elongated pin hole, and an insert having a corresponding mating feature disposed on a top surface thereof, and wherein the insert is mated with the pin hole to mount the hammer in the first position; using the hammer in the hammermill until the hammer is partially worn; and mounting the hammer in a second position on a rotor of a hammermill, wherein the insert is removed from the pin hole to mount the hammer in the second position.

The present invention has several advantages over existing hammer assemblies for hammermills. Such advantages of the invention will be made apparent to those skilled in the art from the accompanying drawings and detailed description thereof.

BRIEF DESCRIPTION OF THE DRAWINGS

FIG. 5 an enlarged perspective view of the hammer of FIG. 4 illustrating the mating features of the hammer pin hole;

FIG. 6 is a front view of the hammer and pin-hole insert of FIG. 4;

FIG. 7 is an enlarged perspective view of the underside of the pin-hole insert of FIG. 4;

FIG. 8 is an enlarged top view of the pin-hole insert of FIG. 4;

FIG. 9 is an exploded cross-sectional side view of the hammer and pin-hole insert of FIG. 4, taken along the vertical plane 9-9 of FIG. 4;

FIG. 14 an enlarged perspective view of the hammer of FIG. 12 illustrating the mating features of the hammer pin hole;

FIG. 15 is a front view of the hammer and pin-hole insert of FIG. 12;

FIG. 19 is a cross-sectional side view of the hammer and pin-hole insert of FIG. 12, taken along the vertical plane 19-19 of FIG. 12.

DETAILED DESCRIPTION OF THE PREFERRED EMBODIMENTS

Figure 1:
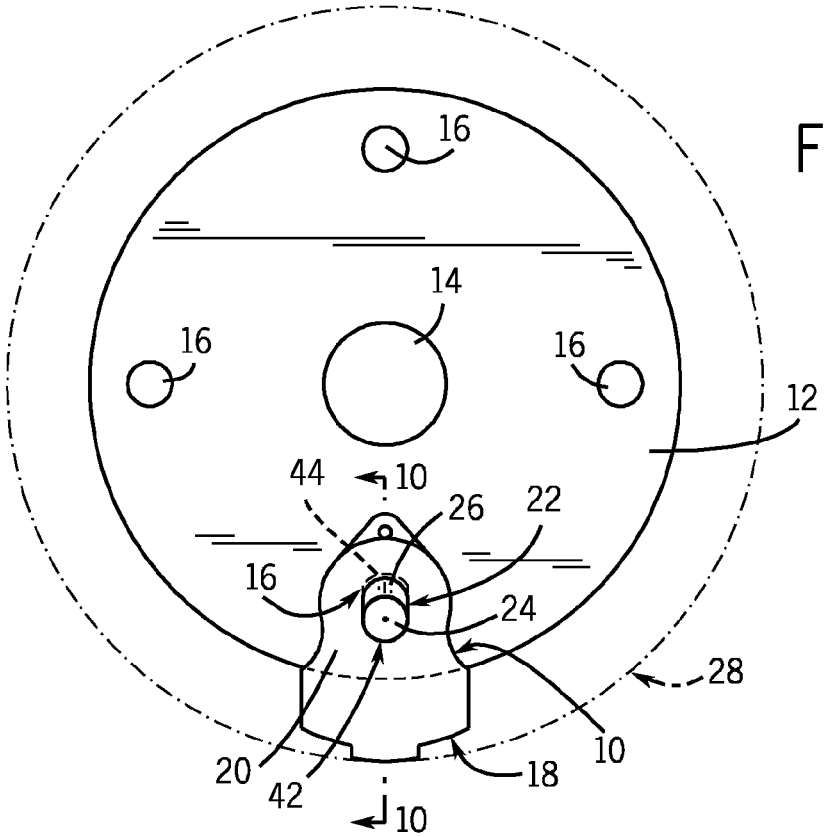
FIG. 1 is a side view of one embodiment of a hammer according to the present invention mounted in a first position on a rotor and shaft of a hammermill.

The present invention is a hammer with a pin-hole insert for use in hammermills. Referring now to the drawings, FIG. 1 shows a hammer 10 according to the present invention mounted in a first position on a rotor 12 and shaft 14 of a hammermill. The rotor has four pin holes 16 for mounting hammers thereto, but only one hammer 10 is shown for purposes of illustration. Other numbers of pin holes 16 and hammers 10 could be used. A disc rotor is shown, but other types of rotors could also be used such as radial or spider rotors. The hammer 10 includes an impact end 18 and a body 20. Other hammer types could also be used, such as those having multiple and/or opposing impact ends, some of which are known as bell-type and bow tie-type hammers. The body 20 of the hammer 10 shown includes an elongated pin hole 22 for receiving a pin 24 for mounting the hammer 10 to the rotor 12. The elongated pin hole 22 has a first end 42 and a second end 44. In FIG. 1, a pin-hole insert 26 is disposed in the elongated pin hole 22 of the hammer 10. The hammer 10 extends past the rotor 12 such that when the rotor rotates, the outermost point on the impact end 18 of the hammer 10 travels substantially along the rotation path 28 as shown.

Figure 2:
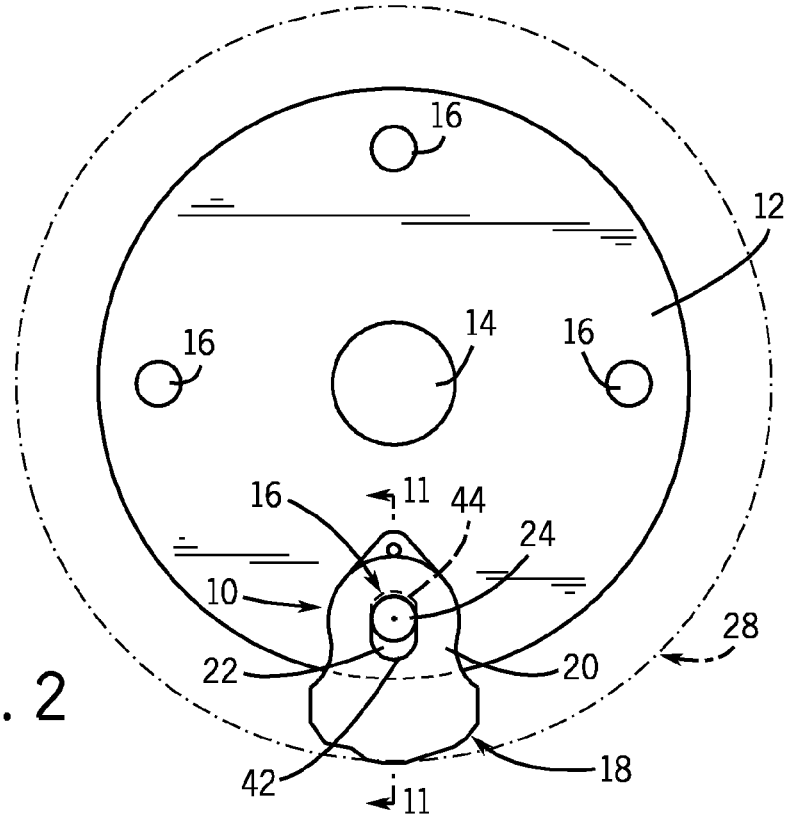
FIG. 2 is a side view of one embodiment of a hammer according to the present invention mounted in a second position on a rotor and shaft of a hammermill.
Figure 3:
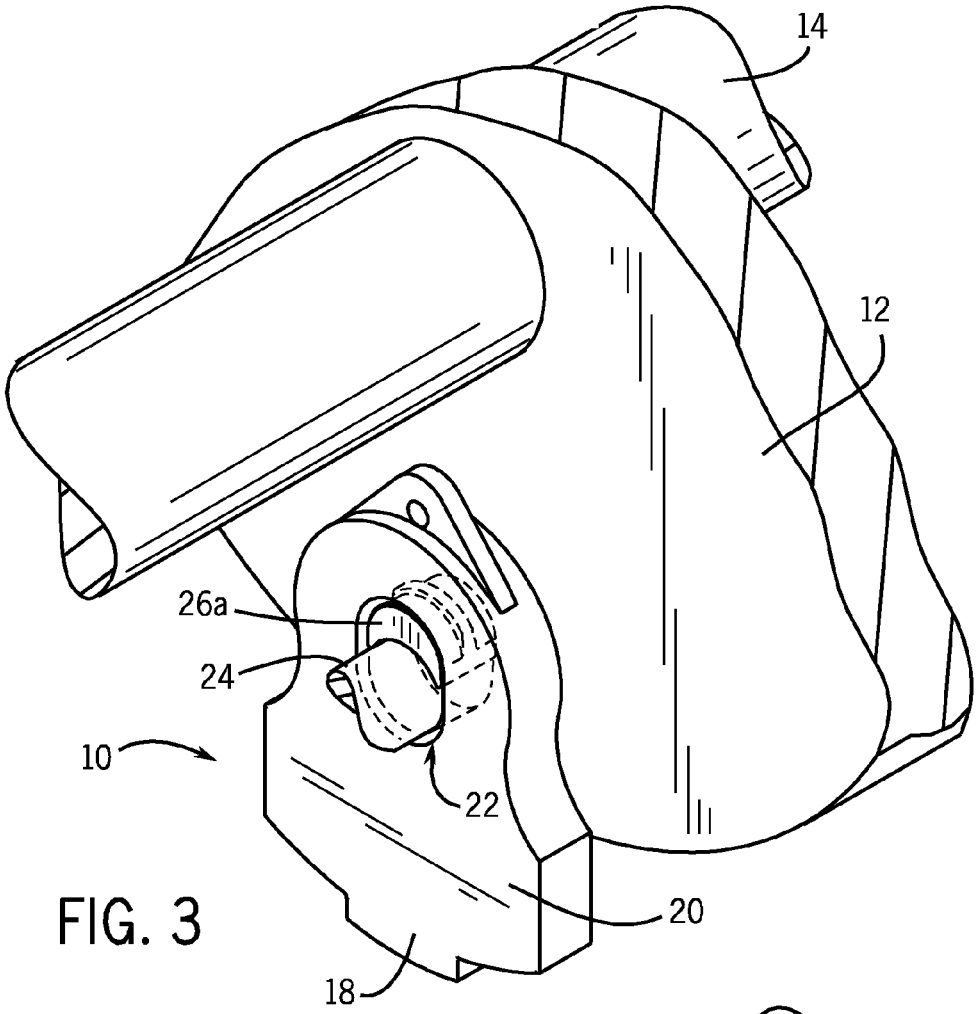
FIG. 3 is a perspective view of one embodiment of a hammer and pin-hole insert according to the present invention mounted in a first position on a rotor and shaft of a hammermill.
Figure 4:
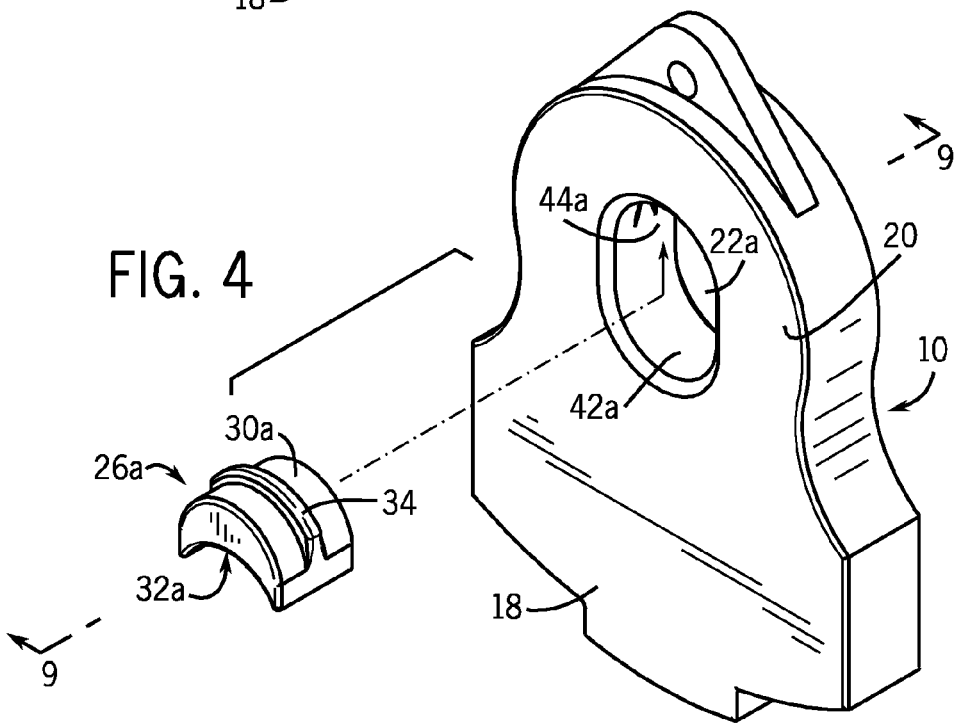
FIG. 4 is an exploded perspective view of one embodiment of a hammer and pin-hole insert according to the present invention.
Figure 10:
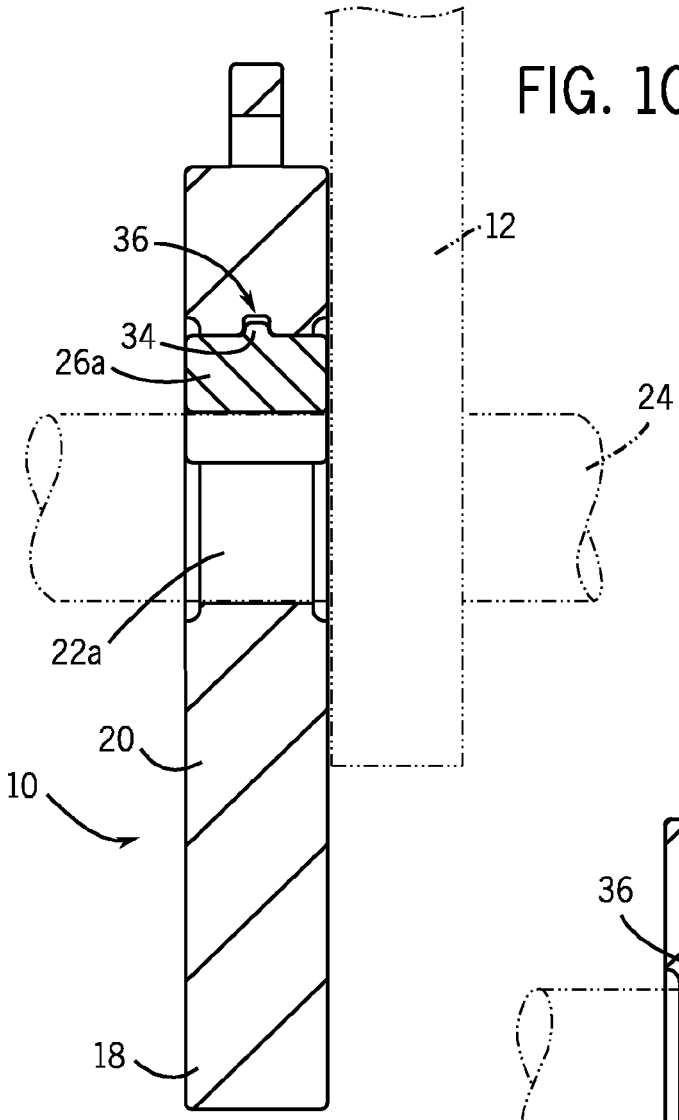
FIG. 10 is a cross-sectional view of the hammer of FIG. 1, taken along the vertical plane 10-10 in FIG. 1 and showing the rotor and hammer pin in phantom.
Figure 11:
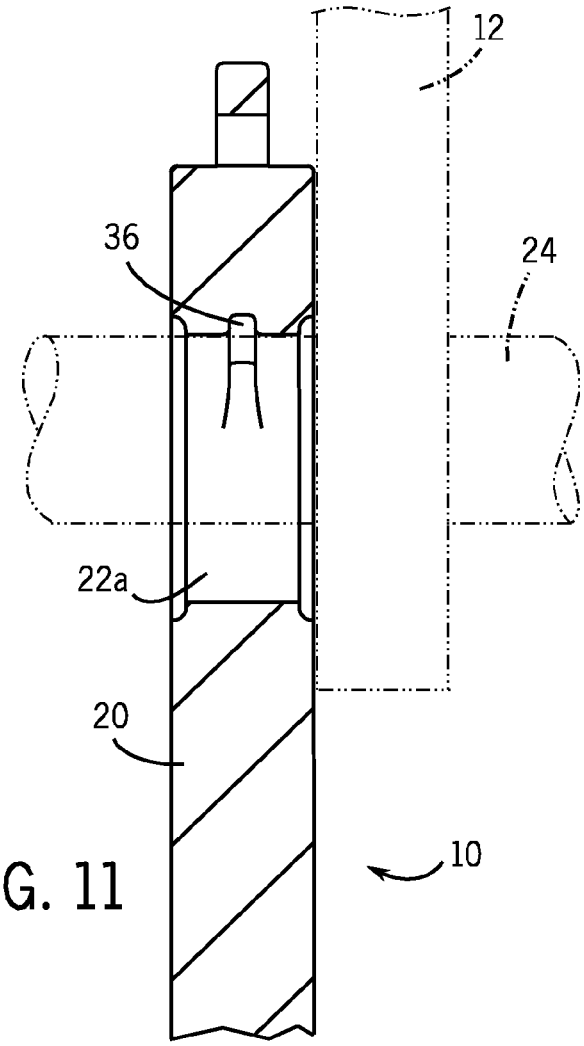
FIG. 11 is a cross-sectional view of the hammer of FIG. 2, taken along the vertical plane 11-11 of FIG. 2 and showing the rotor and hammer pin in phantom.
Figure 12:
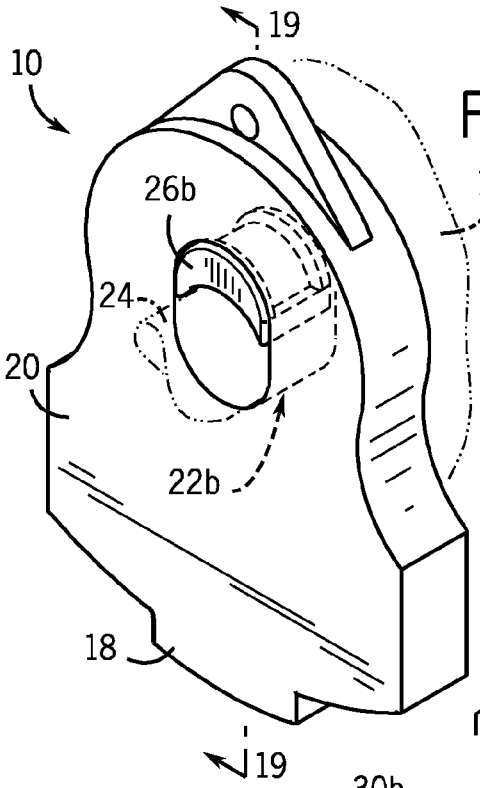
FIG. 12 is a perspective view of another embodiment of a hammer and pin-hole insert according to the present invention mounted in a first position on a rotor and shaft of a hammermill.
Figure 13:
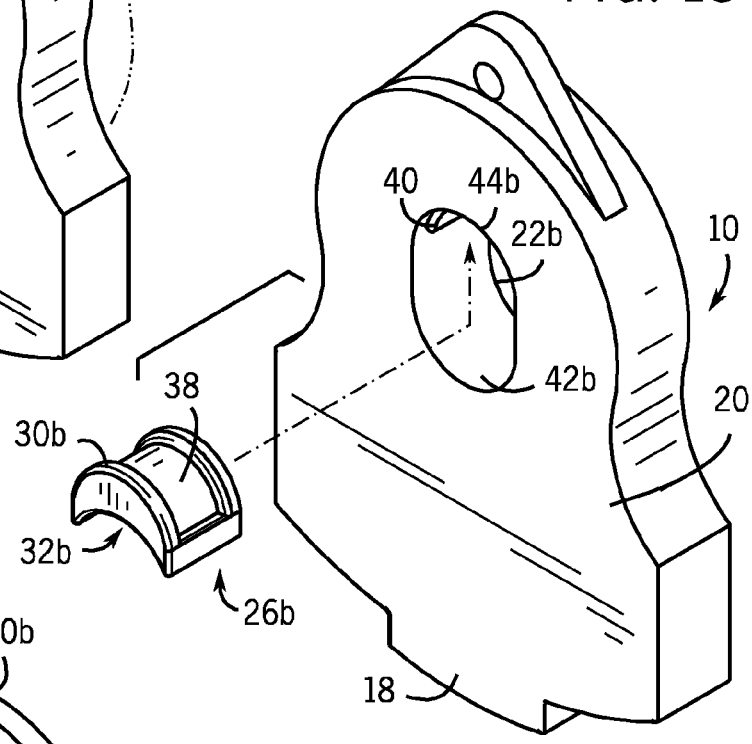
FIG. 13 is an exploded perspective view of the hammer and pin-hole insert of FIG. 12.
Figure 16:
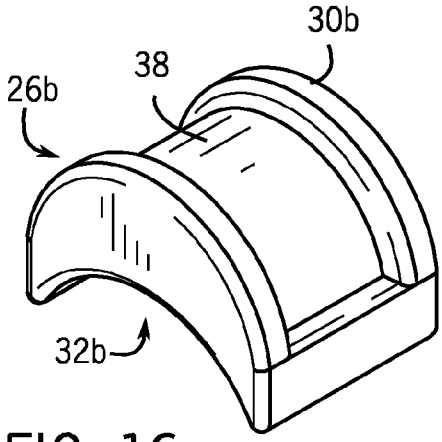
FIG. 16 is an enlarged perspective view of the top side of the pin-hole insert of FIG. 12.
Figure 17:
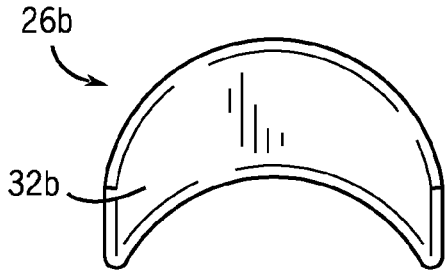
FIG. 17 is an enlarged perspective view of the underside of the pin-hole insert of FIG. 12.
Figure 18:
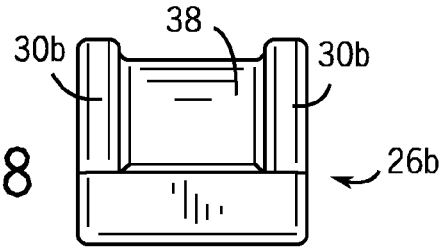
FIG. 18 is an enlarged side view of the pin-hole insert of FIG. 12.

FIG. 2 shows a worn hammer 10 according to the present invention mounted in a second position on a rotor 12 and shaft 14 of a hammermill. In the second position shown in FIG. 2, the pin-hole insert 26 of FIG. 1 has been removed to allow the worn hammer 10 to extend further from the rotor 12 thereby extending the useful life of the hammer 10. Preferably, the hammer 10 is moved to the second position shown in FIG. 2 when the hammer 10 has worn to the extent that its rotation path is no longer effective for shredding material. When moved to the second position, the worn hammer 10 ideally then has a rotation path 28 shown in FIG. 2 that is substantially the same radial distance from the shaft 14 as the rotation path 28 shown in FIG. 1. The hammer 10 can preferably rotate 360 degrees around the hammer pin 24 without hitting the rotor 12 whether mounted in the first position or the second position, but such a configuration is not required.

The elongated hammer pin hole 22 and the pin-hole insert 26 can have a number of different shapes and configurations. Two embodiments that have been found to be particularly effective for use in heavy industrial hammermills are shown in detail in FIGS. 3-11 and 12-19. In the embodiment shown in FIGS. 3-11, the pin-hole insert 26*a* is generally crescent-shaped and has a top surface 30*a* and a bottom surface 32*a*. The top surface 30*a* is shaped to mate with the hammer pin hole 22*a* and the bottom surface 32*a* is shaped to accommodate the hammer pin 24*a*. The top surface 30*a* includes a longitudinal projection 34. The pin hole 22*a* has a first end 42*a* and a second end 44*a* and includes a longitudinal inlet 36 disposed in the second end 44*a*. The longitudinal projection 34 of the insert 26*a* mates with the longitudinal inlet 36 of the pin hole 22*a*. The projection 34 and inlet 36 have substantially rectangular cross-sections, however, a number of different shapes and configurations could also be used. For example, other cross-sectional shapes could be used, multiple projections and inlets could be used, and non-longitudinal configurations could be used. To install the pin-hole insert 26*a*, the insert 26*a* is placed into the hammer pin hole 22*a*, the projection 34 is aligned with the inlet 36 and the insert 26*a* is pressed into place. The hammer pin 24 then holds the insert 26*a* in place.

In the embodiment shown in FIGS. 12-19, the pin-hole insert 26*b* is generally crescent-shaped with a top surface 30*b* and a bottom surface 32*b*. The top surface 30*b* is shaped to mate with the hammer pin hole 22*b* and the bottom surface 32*b* is shaped to accommodate the hammer pin 24*b*. The top surface 30*b* includes a longitudinal depression 38. The pin hole 22*b* has a first end 42*b* and a second end 44*b* and includes a longitudinal projection 40 disposed in the second end 44*b*. The longitudinal depression 38 of the insert 26*b* mates with the longitudinal projection 40 of the pin hole 22*b*. The depression 38 and projection 40 have substantially rectangular cross-sections, however, a number of different shapes and configurations could also be used. For example, other cross-sectional shapes could be used, multiple depressions and projections could be used, and non-longitudinal configurations could be used. To install the pin-hole insert 26*b*, the insert 26*b* is placed into the hammer pin hole 22*b*, the depression 38 is aligned with the projection 40 and the insert 26*b* is pressed into place. The hammer pin 24 then holds the insert 26*b* in place.

When a new hammer 10 is installed on a rotor 12, the insert 26 is installed into the pin hole 22. As the hammer 10 wears, less of the hammer 10 extends past the rotor 12 to impact and shred scrap material. Eventually, the hammer 10 will wear to a point that it is inefficient or ineffective for shredding. Using the hammer 10 of the present invention, the insert 26 can be removed from the hammer 10 to allow the hammer 10 to again extend past the rotor 12 so as to be effective for shredding material. Thus, removal of the insert 26 allows the hammer 10 to move from a first position to a second position. The insert 26 does not need to be re-installed in the pin hole 22 to mount the hammer 10 in the second position, which is an advantage of the present invention, but it would be possible to do so by adding mating features to the first end of the elongated pin hole. The use of the hammer and pin-hole insert of the present invention extends the life of the hammer 10, and provides the other benefits and advantages described herein.

The embodiments described herein and variations thereof allow for the use of a longer, heavier hammer and reduce the percentage of material wasted as a result of a hammer reaching the end of its useful life. For example, a traditional hammer might weigh 1000 pounds when new and 800 pounds when worn to the need for replacement, resulting in 80% of the hammer material going to waste. The longer, heavier hammer of the present invention might weigh 1200 pounds when new, 1000 pounds when the insert is removed and the hammer is moved to the second position, and 800 pounds when it is in need to replacement. Thus, only 66% of the hammer material is wasted. Using the embodiments described herein, or variations of those embodiments, will result in an insert that is locked into place by the hammer pin and cannot rotate or otherwise move relative to the hammer due to the mating features of the insert and hammer pin hole. The embodiments described herein and variations thereof are also beneficial because they do not require additional installation or removal time or complicated adjustments in the hammermill, and do not create additional cavities in which scrap material can accumulate. The embodiments described herein are also particularly useful for heavy industrial scrap shredders that are subjected to much greater impacts than other types of shredders such as those used for refuse or solid waste.

While the invention has been described with reference to preferred embodiments, those skilled in the art will appreciate that certain substitutions, alterations and omissions may be made to the embodiments without departing from the spirit of the invention. Accordingly, the foregoing description and embodiments discussed are meant to be exemplary only, and should not limit the scope of the invention.

What is claimed is:

1. A hammer assembly for a hammermill, the hammer assembly comprising:

a shaft;

at least one rotor mounted on the shaft;

at least one hammer mounted on the rotor, the at least one hammer having an elongated pin hole having a first end and a second end with a mating feature disposed within the second end thereof;

at least one insert having a top surface and a bottom surface, the top surface having a corresponding mating feature disposed thereon and the bottom surface shaped to accommodate a hammer pin;

wherein the hammer is mounted on the rotor in a first position when the insert is mated with the pin hole and the hammer is mounted on the at least one rotor in a second position when the insert is removed from the pin hole; and wherein the insert is held in place by the hammer pin.

2. The assembly of claim 1, wherein the mating feature disposed within the pin hole is a longitudinal inlet and the corresponding mating feature on the insert is a longitudinal projection.

3. The assembly of claim 1, wherein the mating feature disposed within the pin hole is a longitudinal projection and the corresponding mating feature on the insert is a longitudinal depression.

4. The assembly of claim 1, wherein the cross-sectional shape of the mating features is rectangular.

5. The assembly of claim 1, wherein the insert is generally crescent-shaped.

6. A hammer for a hammermill, the hammer comprising:

at least one impact end and a body;

an elongated pin hole in the body;

a longitudinal mating feature disposed within the elongated pin hole;

an insert having a corresponding mating feature disposed on a top surface thereof; and wherein the insert is mated with the pin hole to mount the hammer in a first position on a rotor and wherein the insert is removed from the pin hole to mount the hammer in a second position on a rotor.

7. A method for prolonging the life of a hammer in a hammermill, the method comprising:

mounting a hammer in a first position on a rotor of a hammermill, wherein the hammer includes at least one impact end and a body, an elongated pin hole in the body, a longitudinal mating feature disposed within the elongated pin hole, and an insert having a corresponding mating feature disposed on a top surface thereof, and wherein the insert is mated with the pin hole to mount the hammer in the first position;

using the hammer in the hammermill until the hammer is partially worn; and mounting the hammer in a second position on a rotor of a hammermill, wherein the insert is removed from the pin hole to mount the hammer in the second position.

* * * * *